United States Patent [19]

Dibrell

[11] 4,420,945

[45] Dec. 20, 1983

[54] METHOD AND APPARATUS FOR EXTRACTING ENERGY FROM A PRESSURED GAS

[75] Inventor: Edwin W. Dibrell, San Antonio, Tex.

[73] Assignee: Centrifugal Piston Expander, Inc., San Antonio, Tex.

[21] Appl. No.: 451,606

[22] Filed: Dec. 20, 1982

Related U.S. Application Data

[63] Continuation-in-part of Ser. No. 436,412, Oct. 25, 1982.

[51] Int. Cl.[3] ..... F25D 9/00

[52] U.S. Cl. ..... 62/86; 62/403; 62/467 R; 62/499; 165/86

[58] Field of Search ..... 62/401, 403, 467 R, 62/499, 86; 165/86

[56] References Cited

U.S. PATENT DOCUMENTS

| | | | |
|---|---|---|---|
| 1,323,785 | 12/1929 | Nichol | 62/403 |
| 1,511,985 | 10/1924 | Spencer | 62/403 |
| 2,174,584 | 10/1939 | Imus | 62/136 |
| 2,175,162 | 10/1939 | Waterfill | 62/136 |
| 2,716,971 | 9/1955 | Sykes | 123/46 |
| 2,730,874 | 1/1956 | Schelp | 62/402 |
| 3,052,106 | 9/1962 | Sampietro et al. | 62/402 |
| 3,648,670 | 3/1972 | Siddons | 123/43 R |
| 3,896,632 | 7/1975 | Huntley | 62/88 |
| 4,022,032 | 5/1977 | Nott | 62/499 |
| 4,197,715 | 4/1980 | Fawcett et al. | 62/467 R |

*Primary Examiner*—Ronald C. Capossela

*Attorney, Agent, or Firm*—Wilson, Fraser, Barker & Clemens

[57] ABSTRACT

The disclosure provides a method and apparatus for extracting heat and/or mechanical energy from a pressured gas wherein the pressured gas is applied to the radially outer ends of rotating cylinder elements defining longitudinally extending pressure chambers having one end thereof remote from the axis of rotation and the other end proximate to the axis of rotation. A free piston is mounted in each of the fluid pressure chambers and is reciprocable therein solely under the influence of the gas pressure and centrifugal force. Valving elements are provided at the outer end of the cylinder elements which are operable by sensing elements which are respectively mounted on each of the cylinders and generate signals in accordance with the position of the free piston in the respective cylinder. Electronic circuitry is provided to insure that the inlet valves of each pair of diametrically opposed cylinders are concurrently operated to an open position to assure the dynamic balance of the rotating system.

34 Claims, 14 Drawing Figures

METHOD AND APPARATUS FOR EXTRACTING ENERGY FROM A PRESSURED GAS

RELATIONSHIP TO OTHER PENDING APPLICATIONS

This application constitutes a continuation-in-part of my co-pending application Ser. No. 436,412, filed Oct. 25, 1982, and assigned to the assigness of the instant invention.

BACKGROUND OF THE INVENTION

1. Field of the Invention

The invention relates to a method and apparatus for efficiently extracting heat and mechanical energy from a pressured gas by expanding same in a plurality of rotating fluid pressure chambers.

2. Description of the Prior Art

Many mechanisms and methods have heretofore been proposed for effecting the extraction of heat from a refrigerant fluid as one step in the operation of an air conditioning or refrigerating system. The most common method of heat removal is by conducting the heated refrigerant fluid through a heat exchanger and subjecting it to the cooling action of a flow of cooling air or water. Such systems necessarily involve the location of the cooling mechanism exteriorly of the space to be air conditioned or refrigerated. Most conventional cooling systems therefore required one motor to effect the compression of the refrigerant fluid to convert it from a gas to a liquid and to drive a cooling fan for removing the heat involved in the compressor operation, and a second motor to move room air through an evaporator. The cooling was achieved by evaporation of the liquified refrigerant fluid in the evaporator to produce a cooling effect on air or other fluid stream passing in proximity to the evaporator. In any event, most prior art systems involve the use of substantial amounts of energy to effect the desired cooling action. Furthermore, special refrigerant fluids, such as Freon, were required.

In the co-pending application of James G. Adams, Ser. No. 343,240, filed Jan. 28, 1982, and assigned to the assignees of the instant application, there is disclosed a prime mover for an air conditioning system which involves the extraction of both heat and mechanical energy from a pressured refrigerant gas through the non-combustible expansion of such gas in a piston and cylinder assembly wherein the piston and cylinder are relatively movable with respect to each other. Such piston and cylinder assemblies are, however, mounted on a rotating supporting body and positioned on such body so that the path of relative linear movement of the piston and cylinder elements is disposed in a plane substantially normal to the axis of rotation and is radially displaced from the axis of rotation. Such location of the piston and cylinder elements effects displacement of the movable one of such elements to a radially outward position as a consequence of centrifugal force generated by the rotation of the piston and cylinder assembly by the rotating body. A charge of pressured gas is introduced into the piston and cylinder assembly so as to cause a relative movement of the piston and cylinder elements in a direction in opposition to the centrifugal forces acting thereon. The gas pressure reaction force assists in driving the rotating body, while the concurrent expansion of the pressured gas results in a substantial cooling of the confined body of pressured gas.

Hence, the movable one of the piston and cylinder elements assumes a radially inner position at which point exhaust ports are traversed by the piston, permitting the expanded and cooled gas to be exhausted in a chamber defined by an enclosure shell which surrounds the rotating body and the piston and cylinder assemblage.

The apparatus disclosed in the aforementioned James G. Adams application then proposed to effect a compression of the expanded and cooled gas through the centrifugal action of the rotating chamber within which such cooled gas was discharged. Further experimentation has revealed the fact that excessively high rotational speeds of such rotating chamber would be required to effect the condensation of the cooled gas solely by centrifugal force. At the same time, the higher the rotational speed of the rotating body, the higher the pressure of the gas that must be supplied to the cooperating piston and cylinder elements in order to effect displacement of such elements against the ever increasing centrifugal force.

In such prior art apparatus, a connecting rod has been secured to each of the piston elements, and such connecting rods were in turn respectively connected to rocker arms provided on a hub which was rotatable about the axis of the rotating body carrying the piston and cylinder elements. Additionally, each cylinder had to be pivotally mounted on the rotating body. The oscillating movement of the hub imparted by the piston connecting rods was employed to operate control vavles for supplying pressured fluid to, or removing cooled expanded gas from the cylinder chambers. Such connecting rods, hub mechanism and cylinder pivot mountings constituted expensive items to fabricate and maintain in the apparatus.

SUMMARY OF THE INVENTION

This invention provides a plurality of cylinder elements mounted on a body for rotation about an axis wherein the cylinder elements respectively define paths for oscillating movements of cooperating pistons which, in most cases, lies in a plane perpendicular to the axis of rotation and extends from a point proximate to the axis of rotation to a point remote from the point of rotation. Thus, the piston elements are biased by centrifugal force to the radially outermost end of their path of movement.

In my co-pending application Ser. No. 418,651, filed Sept. 16, 1982, there is disclosed a method and apparatus for more efficiently utilizing the expanded cooled gas which is discharged from the rotating cylinders of the Adams construction after the pistons reach their radially inner position. Additionally, there is disclosed a valving arrangement directly operated by the pistons.

In accordance with my above identified parent application, no connecting rods are provided for the pistons, and each piston comprises a literally free body which responds only to the fluid pressure forces exerted upon it by successive charges of pressured gas and the centrifugal forces imparted to it from the rotation of the rotating body. Additionally, each cylinder is rigidly mounted on the rotating body.

The reciprocating movement of such free pistons nevertheless effects the extraction of heat from each charge of gas supplied to each cooperating piston and cylinder element by expansion of the gas as the piston is driven inwardly by the charge of gas against the bias of centrifugal force. The reaction force of such expanding gas is exerted on the end of the cylinder in a direction that imparts additional rotational energy to the rotating body. Thus, a plurality of completely independent, free pistons respectively mounted in cylinder elements carried by a rotating body can extract heat and mechanical energy from successive charges of pressured gas applied to the cylinder elements. More importantly, the utilization of a free piston permits the path of movement of the piston defined by the cylinder to assume an arcuate or curved configuration, which means that the outer end of corresponding curved cylinder may lie in a radial plane for the more effective application of torque to the rotating body by the reaction force of the expanding gas in the curved cylinder. The external contour of the piston is selected to permit the sliding yet sealing movement of the piston along the entire length of the curved cylinder. Thus, pistons in the shape of balls or ellipsoids are employed having an external coating of a durable organic, lubricating and sealing material such as the product marketed under the trademark "Teflon."

In the bove referred to parent application, no means were provided for assuring that the free pistons would move in synchronism with each other. Such synchronous movement of the pistons is desirable in order to maintain the dynamic balance of the rotating assembly. Additionally, it is desirable when utilizing a plurality of pairs of diametrically opposed cylinder elements, that the respective piston element of each diametrically opposed pair move in synachronism with each other, but in timed relationship with the other pairs, thus providing the periodic production of cooled expanded fluid at a more rapid rate and concurrently the production of torque aiding the rotation of the rotating body carrying the cylinders at more frequent intervals than when all of the rotating cylinders are concurrently energized.

In contrast to the mechanical valving arrangements employed in my above identified parent application, the instant invention provides a plurality of sensing means, in the form of detecting coils surrounding each of the rotating cylinder elements and connected through suitable conventional amplifying circuits to provide a signal indicating when the free piston is at a particular position in a respective cylinder. Referably, three such sensing elements are provided on each cylinder, namely, one adjacent the end of the cylinder that is remote from the axis of rotation, one that is adjacent the end of the cylinder that is proximate to the rotating axis and a third sensing unit which is located medially on the cylinder between the remote and proximate ends thereof. A pair of solenoid actuated inlet and exhaust valves are respectively provided on each of the rotating cylinders and such valves are electrically operated in accordance with the position of the free piston in its respective cylinder. Conventional electronic circuitry is provided to insure that the inlet valves of all the cylinders are not opened until all of the free pistons arrive at the remote ends of the cylinders. In accordance with the modification of the invention, the electronic circuitry may provide for the concurrent actuation of the inlet valves of each diametrically opposed pair of cylinder elements and the sequential opening of the inlet valves of the remaining diametrically opposed pairs of cylinders. In either case, it is assured that the diametrically opposed free pistons are moved in substantial synchronism by the pressured gas, thus maintaining the dynamic balance of the rotating body carrying the cylinders.

Further objects and advantages of this invention will be readily apparent to those skilled in the art from the following detailed description, taken in conjunction with the annexed sheets of drawings, on which is shown the preferred embodiments of the invention.

DESCRIPTION OF THE PREFERRED EMBODIMENTS

Figure 2:
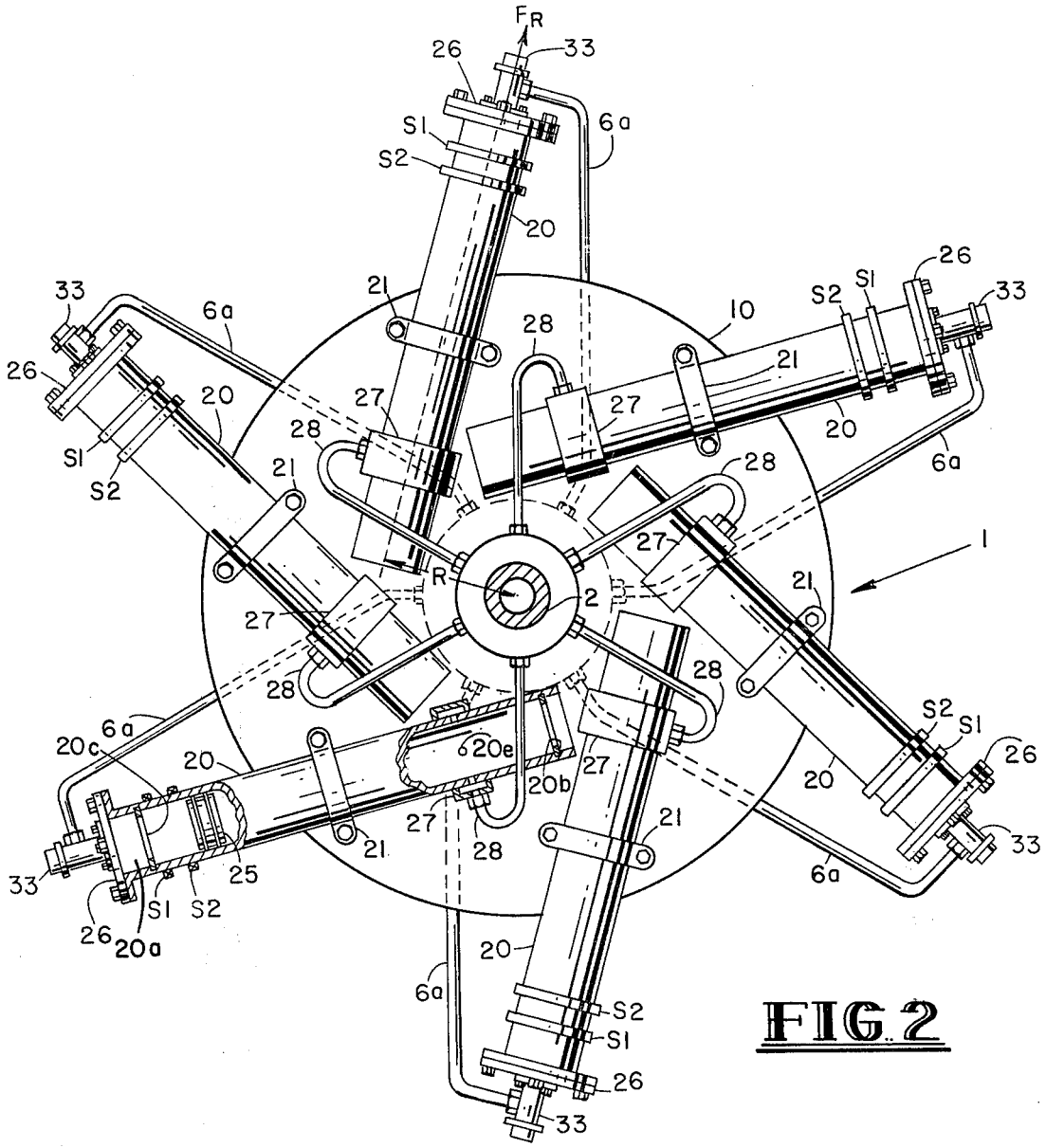
FIG. 2 is a sectional view taken on the plane 2—2 of FIG. 1.
Figure 1:
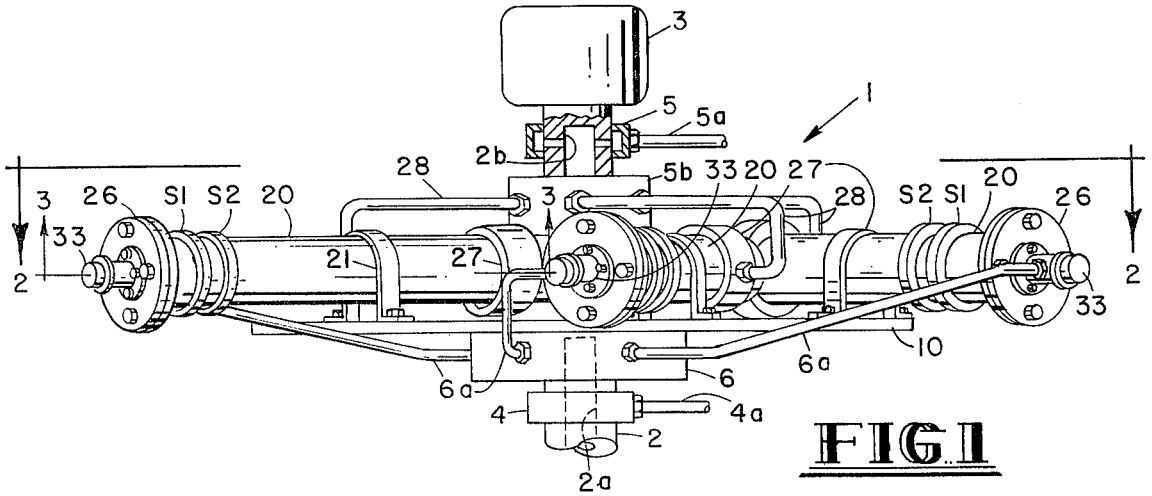
FIG. 1 is a schematic side elevational view of an apparatus embodying this invention.
Figures 3, 6:
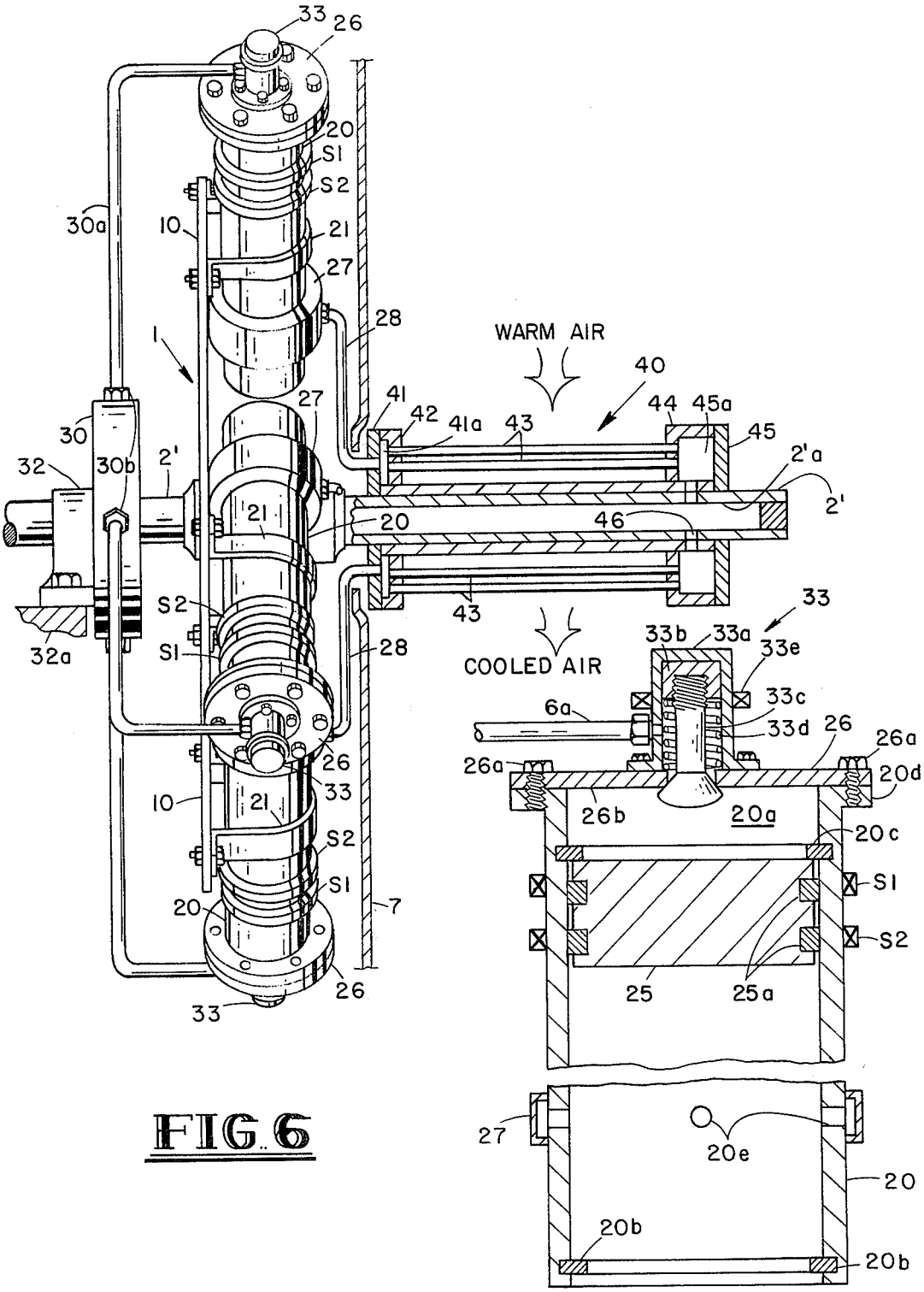
FIG. 3 is an enlarged, partial sectional view taken on the plane 3—3 of FIG. 1.
FIG. 6 is a schematic elevational view, partly in section, illustrating the application of the apparatus of FIGS. 1–3 to a closed cycle air conditioning system.

Referring to FIGS. 1–3, an apparatus 1 for extracting heat and mechanical energy from a pressured gas is illustrated which is generally similar to the apparatus disclosed in my above referred to co-pending parent application. Such apparatus is mounted on a circular plate or body 10 which in turn is keyed to a shaft 2 which is rotated by a suitble electric or fluid pressure starting motor 3. A conventional fluid shaft coupling 4 effects the supply of pressured gas to the apparatus from a stationary supply pipe **4*a* through a hollow bore portion 2*a* of the shaft 2 and into a distributor 6. The expanded and cooled exhaust gases are removed from the apparatus 1 through a conventional fluid shaft coupling 5 and supplied to a stationary exhaust pipe 5*a*. The exhaust coupling 5 communicates with another hollow portion 2*b* of the shaft 2 which, however, is isolated by suitable barrier (not shown) from the hollow bore portion 2*a*** receiving the pressured inlet gases. Shaft bore portion 2*b* communicates with an exhaust gas collector 5*b*.

A plurality of cylinder elements 20 are rigidly mounted on the rotating body plate 10. Each such cylinder element defines a fluid pressure chamber 20*a* having a longitudinal axis which extends from a point proximate to the axis of rotation of the body 10 to a point radially remote from the axis of rotation. Each longitudinal axis of the cylinders 20 is, however, not radially disposed with respect to the axis of rotation of shaft 2 but is spaced therefrom.

To optimize the performance of apparatus 1, as many of the cylinders 20 are applied to the rotating body plate 10 as can be physically accommodated thereon. The exact number employed depends on a number of design factors, such as the pressure of the gas that is available to drive the unit, the space available to accommodate the unit, the rotational speed desired, the power or cooling output desired, and the weight limitations for the unit. Obviously, the larger the diameter of the individual cylinders 20, the smaller will be the total number of such cylinders that can be physically mounted on body plate 10. Likewise, the length of the cylinders 20 substantially increases the centrifugal forces acting on such cylinders and thus requires an increase in weight and strength of the cylinder components 20 as well as the body mounting plate 10 and the power driven shaft 2. In the specific example illustrated in the drawing, six of such cylinder units 20 are shown, and they are respectively secured to body plate 10 by bolted bands 21.

A free piston 25 (FIG. 3) is mounted in each of the bores 20*a* defined by the cylinders 20 for slidable and sealable movements therealong. Since the bore or fluid pressure chamber 20*a* of cylinder 20 is of cylindrical configuration, conventional piston rings 25*a* may be employed on the piston 25 or, alternatively, the pistons could be provided with an external coating of an organic material having good lubricating and sealing properties, such as a polytetrafluoroethylene, sold under the DuPont trademark "Teflon" or a perfluoroelastomer, sold under the DuPont trademark "Kalrez." Pistons 25 are preferably formed from a ferromagnetic material. Radially inward movement of each piston 25 is limited by a snap ring 20*b* mounted in the respective cylinder 20 and outward movement by a snap ring 20*c*. At the outer end of each cylinder 20, an outwardly projecting flange 20*d* is provided to permit a cylinder head 26 to be secured thereto by suitable bolts 26*a*. Centrally mounted on each cylinder head 26 is a solenoid actuated inlet valve 33 which is connected by a conduit 6*a* to a pressured gas distributor 6 which is concentrically mounted on the opposite face of the mounting plate 10. As previously mentioned, pressured gas is supplied to the distributor 6 through the fluid coupling 4 and the hollow bore portion 2*a* of the rotating power shaft 2.

Inlet valve 33 comprises a cylindrical non-ferrous casing 33*a* within which a ferromagnetic core or piston 33*b* is slidably mounted. The valving element 33*c* is threadably secured to the ferromagnetic piston element 33*b* and is normally spring biased to a closed position by spring 33*d*. A conduit 6*a* connects the interior of the valve housing 33*a* to the pressured gas distributor 6. Lastly, an actuating solenoid 33*e* is provided in surrounding relationship to the medial portion of the valve housing 33*a*. Such solenoid, when energized, will cause the ferromagnetic piston element 33*b* to be pulled downwardly to effect the opening of the inlet valve element 33*c*.

From the description thus far, it will be apparent that the pistons 25 move to their outermost positions in the respective fluid pressure chambers 20*a* by the centrifugal force generated by the rotation of power shaft 2 by the starting motor 3. When the pistons 25 reach their outermost position, then through the operation of a control circuit to be hereinafter described, the solenoid actuated inlet valve 33 is actuated to open and permit a charge of pressured gas to be introduced into the fluid pressure chambers 20*a*. If the pressure of such gas charge is sufficiently high, each piston will be moved inwardly against the centrifugal force bias by the force generated by such gas. Obviously, as each piston 25 moves inwardly, the centrifugal force acting on the pistons decreases, so that once inward motion of the piston is started, it will continue. Pistons 25 may be weighted by lead inserts if additional weight is required.

As discussed in my aforementioned parent application, the reaction force of the charge of pressured gas is exerted on the end wall of the fluid pressure chamber 20*a*, here shown as the wall 26*b* of the cylinder head 26. This force is diagrammatically illustrated in FIG. 2 by the arrow labelled $F_R$. It will be seen that the effective torque exerted by the force $F_R$ is the product of such force by the perpendicular distance existing between the axis of the fluid pressure chamber 20*a* and the axis of rotation of the body 10 and the shaft 2.

After each piston 25 initiates its inward movement, the solenoid actuated inlet valve 33 is closed in a manner to be hereinafter described, thus trapping the charge of pressured gas. Such gas is expanded and cooled while acting on the piston 26 to drive it inwardly. The expanded, cooled gas is discharged through a second valve element, hereinafter called the exhaust valve, comprising a plurality of radial ports 20*e* formed in the cylinder wall which are uncovered by the piston 25 just prior to such piston reaching the end of its inward stroke, i.e., arriving at the axis proximate end of the fluid pressure chamber 20*a*. An annular header 27 is provided in surrounding relationship to the exhaust ports 20*e* and conducts the expanded, hence cooled charge of gas through a conduit 28 to the exhaust gas collector 5*b* and to the stationary exhaust conduit 5*a* through fluid coupling 5.

Figure 4:
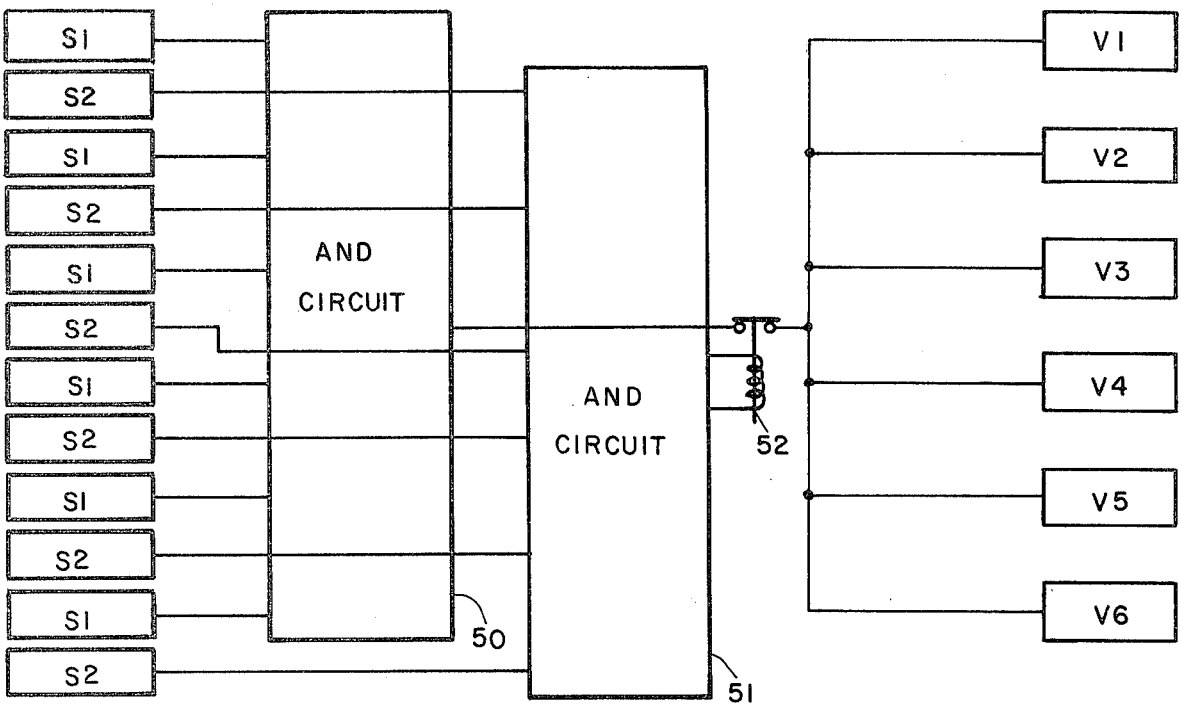
FIG. 4 is a schematic circuit diagram illustrating one control mode for the apparatus of FIG. 1.

Referring now to FIG. 4, there is shown a schematic control circuit for operating each of the solenoid controlled inlet valves 33 which are respectively labelled V1, V2 . . . V6. A pair of sensing devices S1 and S2 are provided on each of the cylinders 20 in order to respectively provide a signal when the free piston 25 is adjacent the position of such sensing device. Sensing device S1 is preferably located to provide a signal when the free piston 25 is in its outermost or remote position relative to the rotation axis. All such signals are supplied to a conventional electronic circuit 50 known as an "AND" circuit which will produce an amplified output signal for concurrent application to all of the solenoid controlled inlet valves V1, V2 . . . V6 only when all of the free pistons 25 have reached their outermost position. It is thereby assured that all such pistons are energized at the same instant, thus providing for substantially synchronous inward movement of the free pistons and hence maintaining the dynamic balance of the rotating assemblage.

The second sensors S2 are mounted on the cylinders 20 at a position radially inward from the sensors S1. The exact location of the sensors S2 depends upon the amount of pressured gas that is desired to be applied to each fluid pressure chamber 20*a*. If the objective of the apparatus is to primarily effect the conversion of the pressured gas into mechanical energy, then the energizing circuit for valves V1, V2 . . . V6 should incorporate a self locking feature and the sensors S2 will be respectively located well inward from the sensor S1 in order to provide for a maximum duration of application of pressured gas to the respective fluid pressure chamber 20*a*. If the objective of the apparatus is, however, to acheve maximum extraction of heat from the pressured gas, then the sensor S2 would be moved to a position much closer to the sensor S1 so that the inlet valves V1, V2 . . . V6 will be closed by the operation of sensors S2 shortly after the initiation of inward movement of the free pistons 25, thus providing maximum expansion of the respective charges of pressured gas. For minimum conditions, sensors S2 may be eliminated and valves V1, V2 . . . V6 closed by cut off of the signal from sensor S1. Sensors S2 are connected through a second "AND" circuit 51 to operate relay 52 which interrupts the supply of actuating current to the solenoid controlled inlet valves V1, V2 . . . V6. Alternatively, each of the sensors S2 could be connected through a separate amplifying circuit and relay directly to the corresponding valve V1, V2 . . . V6 so that each of such valves is closed as a function of the position of the piston in the respective cylinder, rather than effecting the closing at the time that all of the free pistons reach the positions in the fluid pressure chamber corresponding to the locations of the sensors S2. Thus the length of time that the fluid pressure chambers 20*a* are connected to a source of pressured gas may be conveniently varied by varying the position of the sensors S2 respectively on the cylinders 20, or more accurately, varying the position at which the respective free piston 25 will effect the actuation of the sensor S2 to cause the closing of the respective fluid pressure inlet valve V1, V2 . . . V6.

Figure 5:
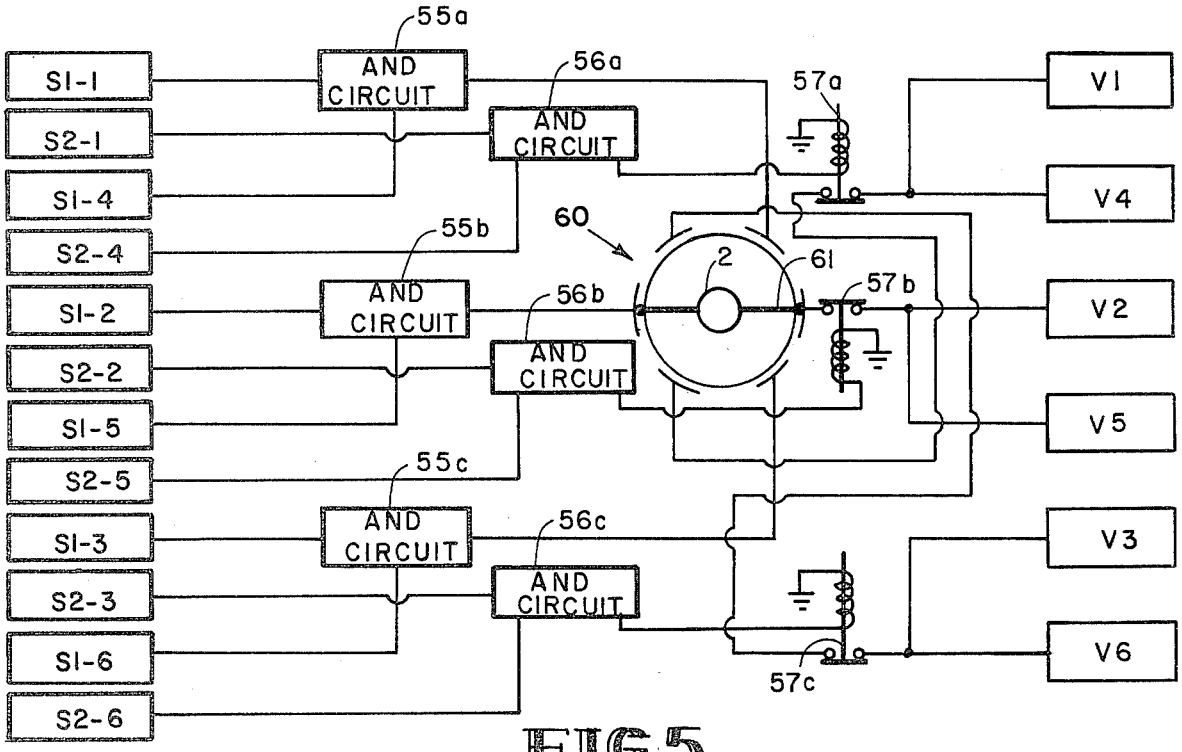
FIG. 5 is a schematic circuit diagram illustrating an alternative control mode for the apparatus of FIG. 1.

In the control mode illustrated in FIG. 4, all of the pistons 25 are concurrently acted on by a charge of gas and hence, start their respective inward strokes at the same time. In this manner, the pistons are maintained in reasonable synchronism and a dynamic balance of the rotating components is assured. It may be preferred to concurrently actuate the pistons of two diametrically opposed cylinders at one time and then periodically thereafter actuate the remaining pairs of diametrically opposed pistons in sequence, thus applying intermittent pulses of power, if that is the primary application of the apparatus, or periodic pulses of cooled, expanded exhaust gas for cooling purposes if that is the primary purpose of the apparatus. This control mode is schematically illustrated in FIG. 5 wherein each of the sensors S1 is now labelled according to the particular cylinder that it is applied to. Thus, sensor designation S1-1 is applied to any selected one of the cylinders 20 and a sensor designation S1-4 is applied to the cylinder 20 that is diametrically opposite the first mentioned cylinder. Sensor designation S1-2 is similarly applied to a second cylinder that is adjacent to the cylinder to which sensor designation S1-1 is applied and sensor designation S1-5 is applied to the cylinder diametrically opposite that cylinder. The remaining two cylinders carry sensor designations S1-3 and S1-6 respectively. Each of the diametrically opposed pairs of cylinders have their respective sensors connected through separate AND circuits 55*a*, 55*b*, and 55*c* so that no signal is produced by any particular AND circuit until the pistons in the respective two diametrically opposed pairs of cylinders have both reached their extreme outward positions. The outputs of the AND circuits 55*a*, 55*b*, and 55*c* are connected to stationary arcuate segments of a mechanical commutator or timing device 60. Commutator 60 cooperates with a rotating diametrical connecting bar 61 on power shaft 2 which effects the respective connections of AND circuits 55*a*, 55*b*, and 55*c* to solenoid actuated inlet valves V1 and V4, V2 and V5, and V3 and V6, but the actuation of each pair of valves is delayed by a time period corresponding a 120° rotation of the power shaft 2. Thus, the diametrically opposed pairs of pistons 25 are concurrently actuated but in timed sequence.

If a very short opening of the inlet valves V1, V2 . . . V6 is desired, this may be accomplished by the mechanical timer 60. If a longer opening period is desired, then the control circuits for the solenoids 33*e* of valves V1, V2 . . . V6 can incorporate a conventional locking circuit (not shown) which will maintain the valves V1, V2 . . . V6 open until relays 57*a*, 57*b*, and 57*c* are opened by operation of sensors S2.

Referring now to FIG. 6, wherein similar numerals represent identical structures previously described, there is shown the apparatus 1 connected to function as a room air cooling device, wherein a refrigerant fluid is recirculated in a closed cycle. The refrigerant fluid may comprise any one of the well known refrigerant gases, but may also constitute any ordinary gas such as nitrogen or air, since the cooling cycle employed does not require the conversion of the gas to a liquid and vice versa as part of the cooling cycle.

A heat exchanger 40 is mounted in surrounding rotatable relationship to the power shaft 2'. Conduits 28 are provided which interconnect each annular header 27 which receive the cooled, expanded charge of gas, to the inlet of heat exchanger 40. Heat exchanger 40 comprises a first end plate member 41 which receives the ends of fluid conduits 28. Immediately adjacent to the end plate 41, there is secured a header 42 which provides a mounting for a plurality of peripherally spaced, axially extending tubes 43 which have their opposite ends mounted in a second header 44 generally similar to the header 42. A second end plate 45 is secured to the second header 44. Annular chambers 41*a* and 45*a* are respectively defined between the end plate 41 and header 42, and between end plate 45 and header 44. Chamber 45*a* is connected to the bore 2'*a* of hollow shaft 2' by radial ports 46 thus permitting the reheated gas to flow through the bore 2'*a* of hollow shaft 2' to the inlet of the rotary compressor unit 30 which is mounted on the other side of the circular mounting plate 10 in the position previously occupied by the pressured gas distributor. The stationary portions 32 of compressor 30 are mounted on a support 32*a*. The outlet of rotary compressor 30 is connected by conduits 30*a* to the inlet ports provided in the side walls of the solenoid actuated inlet valve units 33.

To employ the described apparatus as an air cooling or air conditioning device, it is only necessary to provide suitable duct work and a fan for working a stream of warm air laterally across the rotating heat transfer tubes 43. Rather than showing such conventional duct work, the flow of the air to be cooled has been schematically indicated by arrows and legends on FIG. 4.

The operation of the aforedescribed apparatus will be readily apparent to those skilled in the art. A closed circuit flow of a suitable refrigerant fluid is defined by the described apparatus. Starting with the outlet nipples 30*b* of the compressor 30, such flow extends through conduits 30*a* to the solenoid actuated inlet valves 33 provided on the outer ends of the cylinder elements 20. If the control circuit of FIG. 4 is employed, all such valves 33 are opened when all of the free pistons 25 reach their outermost position. If operated according to the control circuit of FIG. 5, the valves 33 of each diametrically opposed pair of cylinder elements are opened when the respective pistons 25 of the pair of cylinder elements reach their outermost position. In either case, the application of gas pressure from the compressor 30 drives the respective pistons 25 inwardly against the centrifugal force bias. After moving a selected distance determined by the location of the sensor elements S2, the respective inlet valves 33 are closed and the gas charge is trapped and hence expands and cools while it continues to drive the respective pistons 25 inwardly. of course, the reaction force produced by the expanding gas is exerted on the outer end of each cylinder 20 and provides a torque to aid in the rotation of the entire rotating assemblage.

When each free piston 25 arrives at its radially innermost position, as determined by the stop ring 20*b*, the exhaust ports 20*e* are opened and the expanded, cooled gas is thus applied through the annular header 27 and conduits 28 to the inlet side of the heat exchanger 40. The suction exerted by compressor 30 aids this gas movement. The expanded, cooled gas passes through the heat transfer tubes 43 of heat exchanger 40, absorbing heat from the room air passing thereover, and is heated thereby. The reheated gas is directed through the outlet port 46 into the bore 2'*a* of the hollow power shaft 2' and then into the fluid inlet of the compressor 30. As mentioned, the particular advantage of the aforedescribed system is that during the expansion movement of each free piston 26 by the charge of pressured gas, the reaction force of the expanding gas is exerted on the outboard end of the fluid pressure chamber 20*a* and this force is in the direction to aid in the rotation of the power shaft 2. Thus, the energy requirements for operating this system are substantially reduced due to the extraction of mechanical energy from the expansion of the pressured gas. More importantly, the number of moving parts has been significantly reduced.

Those skilled in the art will recognize that the aforedescribed apparatus only effects a predetermined range of reduction in temperature of the refrigerant gas which is determined primarily by the amount that the gas is expanded. If the purpose of the apparatus is to effect room cooling, and the range of temperature reduction is on the order of 30° F., then obviously, the temperature of the pressured gas entering the plurality of cylinder elements 20 must not be in excess of 100° F. or less, to provide any effective amount of room cooling. It is also obvious that the action of the compressor 30 in compressing the reheated gas will inherently increase the temperature of the gas. Accordingly, in most instances, it will be necessary to physically locate the compressor 30 and the driving motor (not shown) for power shaft 2' in a separate room or chamber that is separated from the chamber to be cooled by a suitable wall of heat insulating material. Since the cylinder elements 20 are rotating, such wall may most conveniently be located between the rotating body 10 and heat exchanger 40 as indicated schematically by the numeral 7 in FIG. 4.

It may also be necessary to run the compressed gas exiting from the compressor 30 through a heat exchange type cooling device and this device (not shown) should be located on the side of the heat insulating barriers 7 opposite to the heat exchanger 40. the fan (not shown) for any such gas cooling heat exchanger can, of course, be driven by power shaft 2'.

Figure 7:
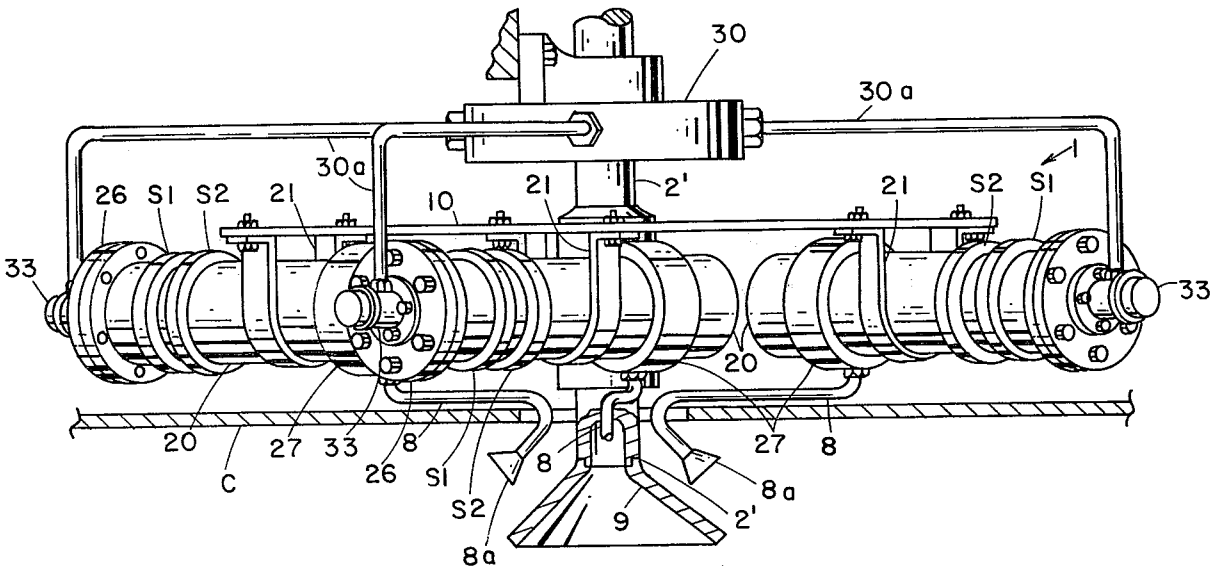
FIG. 7 is a schematic elevational view, partly in section, of the apparatus of FIGS. 1–3 as applied to an open cycle in a cooling system.

Referring now to FIG. 7, there is shown a modification of this invention wherein the apparatus 1 is constructed to function as a room air cooling device wherein air is employed as a refrigerant fluid in an open cycle. Thus, the cooled, expanded air discharge from the fluid pressure chambers 20*a* through the annular headers 27 is directed into the room area to be cooled by conduits 8 and nozzle elements 8*a* on the ends of such conduits, which are, of course, rotating. With such an arrangement, a very efficient distribution of cool air into the room area can be achieved by mounting the power shaft 2' in a vertical position adjacent to the ceiling C of the room and disposing the remainder of the apparatus 1, namely the driving motor (not shown), the compressor 30 and the plurality of cylinder elements 20 each containing a free piston 25, above the ceiling C of the room to be cooled. Return air may be conveniently picked up by the open end of the power shaft 2' on which a conical baffle 9 is mounted.

From the foregoing description, it is apparent that this invention may be utilized in an apparatus which is primarily designed to extract mechanical energy from pressured gas, as illustrated by the modification of FIGS. 1 and 2. Alternately, the principles of this invention may be employed to extract both mechanical energy and heat from a pressured gas to function as an air cooling system accordingly to a closed cycle, pursuant to the modification of FIG. 6, and in an open cycle with air as a refrigerant fluid in accordance with the modification of FIG. 7.

All of these modifications of the invention may be substantially improved in their operating characteristics by increasing the length of the fluid pressure chambers 20*a* of the cylinders 20. As previously mentioned, in connection with the modification of FIGS. 1 and 2, the longer that the charge of pressured gas is permitted to operate on the free piston, the greater will be the reaction force torque applied to the rotating body. On the other hand, when the cooling capability of the apparatus is a predominant factor to be achieved, an extension of the length of the fluid pressure chambers 20*a* will permit a greater degree of expansion of the trapped charge of pressured gas thus, achieving a greater amount of cooling. These objectives may be conveniently accomplished according to the modification schematically illustrated in FIG. 8 and in other cylinder configurations specifically described and claimed in my aforesaid co-pending parent application.

Figure 8:
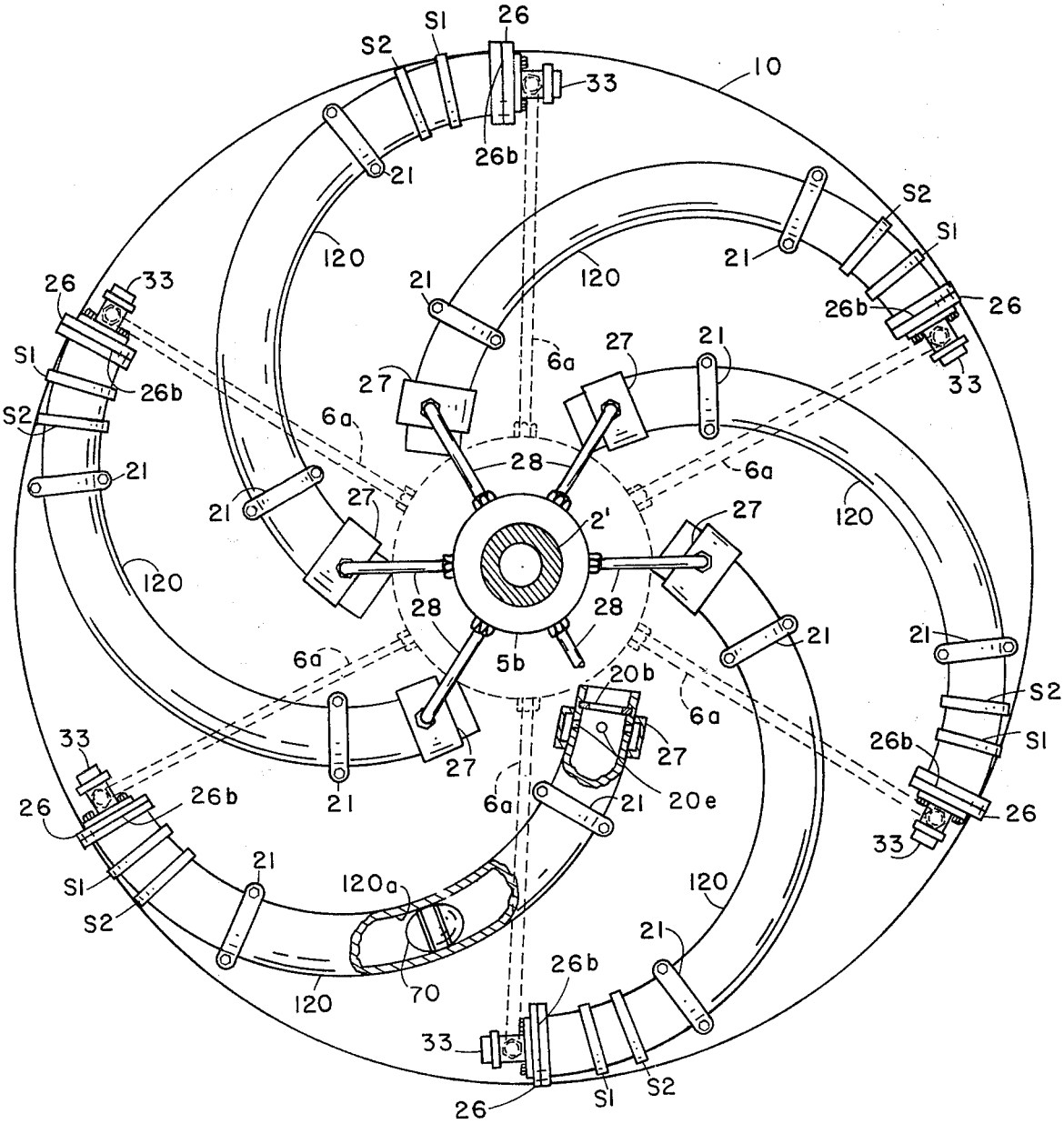
FIG. 8 is an elevational view, partly in section, of a modified form of apparatus embodying this invention employing cylinder elements having arcuate longitudinal axes.

Referring to FIG. 8, where identical numbers represent components previously described, a power shaft 2' drives a circular support plate 10. Cylinder elements 120 are mounted on the rotating supporting body 10 by straps 21 and supplied with pressured gas by conduits 6*a* in the same manner as heretofore described, and the cooled expanded gas is removed from the cylinders 120 by an annular header 27 surrounding a plurality of radial ports 20*e*. However, each of the cylinders 120 defines a fluid pressure chamber 120*a* which is of uniform cross-section but has a curved longitudinal axis, thereby increasing the effective length of such chamber. More importantly, the degree of curvature of such chambers is such that the cylinder end wall 26*b* of each chamber is generally radially disposed with respect to the axis of rotation of the power shaft 2'. This means that the reaction force exerted by the expanding gas in the outermost end of the cylinders 120 is at a maximum radial position relative to the axis of rotation, and such torque arm remains constant, so that the reaction torque imparted to the rotating body 10 is at a maximum.

Figure 13:
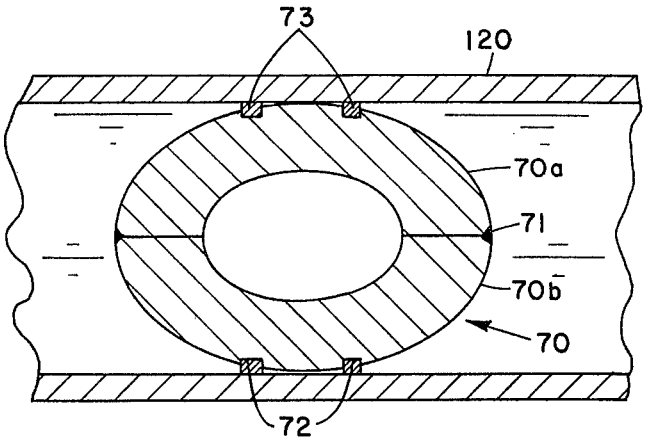
FIG. 13 is an enlarged scale, sectional view illustrating the construction of an oval-shaped piston element employable in cylinders having an arcuate longitudinal configuration.
Figure 14:
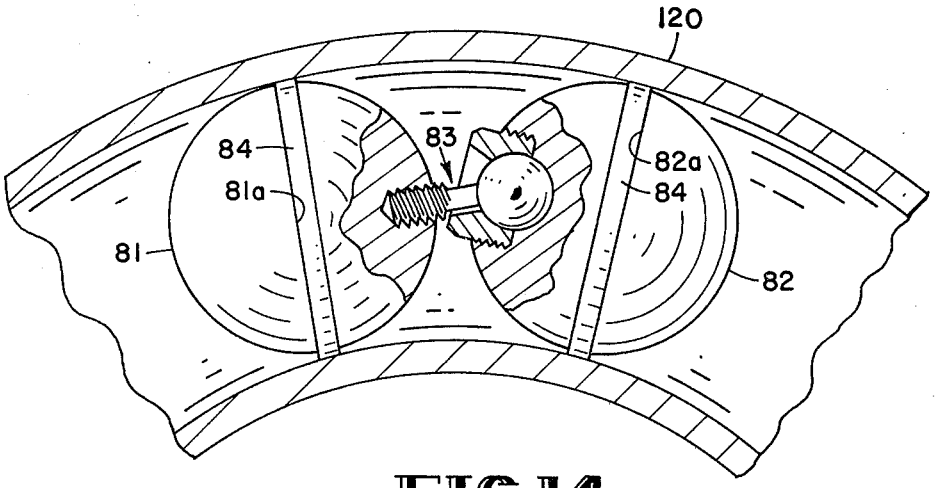
FIG. 14 is an enlarged scale, sectional view illustraing an alternative piston construction employable in cylinders having an arcuate longitudinal configuration.

In the modification of FIG. 8, it will be apparent to those skilled in the art that ordinary cylindrically shaped pistons cannot be employed. As described in my above referred to co-pending parent application, a ball-shaped piston may be employed having a surface coating of an organic plastic having both lubricating and sealing properties, such as the aforementioned plastics marketed under the trademarks "Teflon" and "Kalrez." Alternatively, an ellipsoid-shaped piston coated with such organic plastic may be employed. Referring specifically to FIGS. 13 and 14, there is shown an ellipsoid-shaped piston 70 comprising two ferromagnetic half shell portions 70*a* and 70*b* secured together by a peripheral weld 71. Adjacent the maximum cross-sectional diameter region of the ellipsoid piston 60 there is provided a pair of piston ring grooves 72 which respectively receive conventional piston rings 73. Such piston can obviously traverse the curved portions of the fluid pressure chambers having longitudinally curved axes. The interior of piston 70 may be weighted with lead.

Referring to FIG. 14 there is shown a further piston construction which is described and claimed in my co-pending application Ser. No. 436,412 filed Oct. 25, 1982. The piston 80 comprises an assemblage of two or more solid ferromagnetic spherical elements 81 and 82 which are pivotally united by a ball joint 83. With this arrangement each of the balls 81 and 82 may have a circular groove 81*a* and 82*a* for receiving a piston ring 84.

In some instances, it may be desirable to effect the forced exhaust of the cooled, expanded gases from the cylinder elements, rather than relying upon any pressure differential between such gases and the ambient pressure, or upon the suction pressure of the compressor in the case of a closed cycle air conditioning system. Obviously, the exhaust ports 20*e* in each of the cylinders 20 are open for only a very short time while the free piston 25 is in its axis proximate position. To overcome this problem, the modifications of FIGS. 9 through 11 have been developed.

Figure 9:
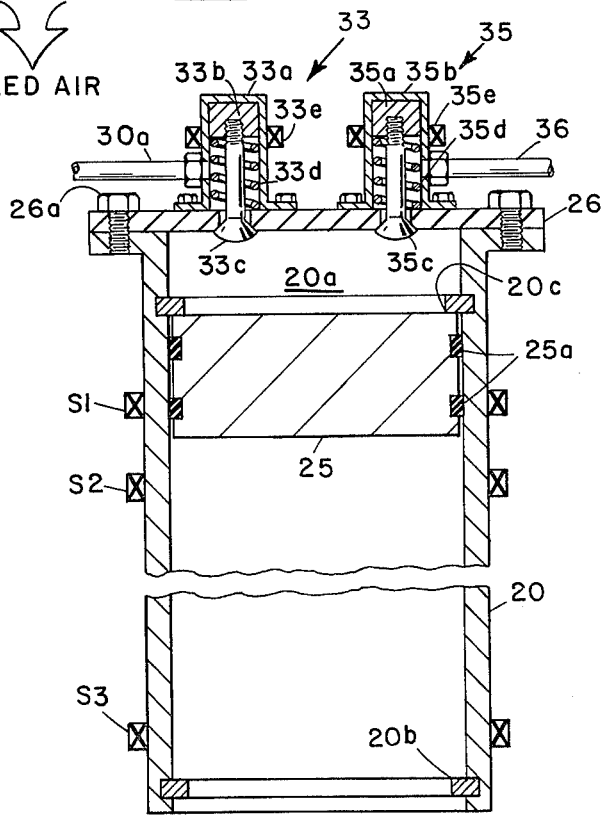
FIG. 9 is an enlarged scale partial sectional view of a modified cylinder for apparatus embodying this invention incorporating solenoid controlled inlet and exhaust valves.

Referring first to FIG. 9, the exhaust of cooled, expanded gas from the fluid pressure chamber 20*a* is accomplished by a solenoid actuated exhaust valve 35 which is mounted on the cylinder head 26. The exhaust valve 35 is of identical construction to the solenoid actuated inlet valve 33 and thus comprises a cylindrical non-ferrous casing 35*a* within which a ferromagnetic piston 35*b* is slidably mounted. A valving element 35*c* is threadably secured to the ferromagnetic piston element 35*b* and is normally spring biased to a closed position by a spring 35*d*. Conduits 36 respectively connect to the interior of the valve housings 35*a* through radial ports located below the ferromagnetic piston element 35*b*. An actuating solenoid 35*e* is provided in surrounding relationship to the medial portions of the valve housing 35*a*. Such solenoid, when energized, will cause the ferromagnetic piston element 35*b* to be pulled downwardly to effect the opening of the exhaust valve 35.

Figure 10:
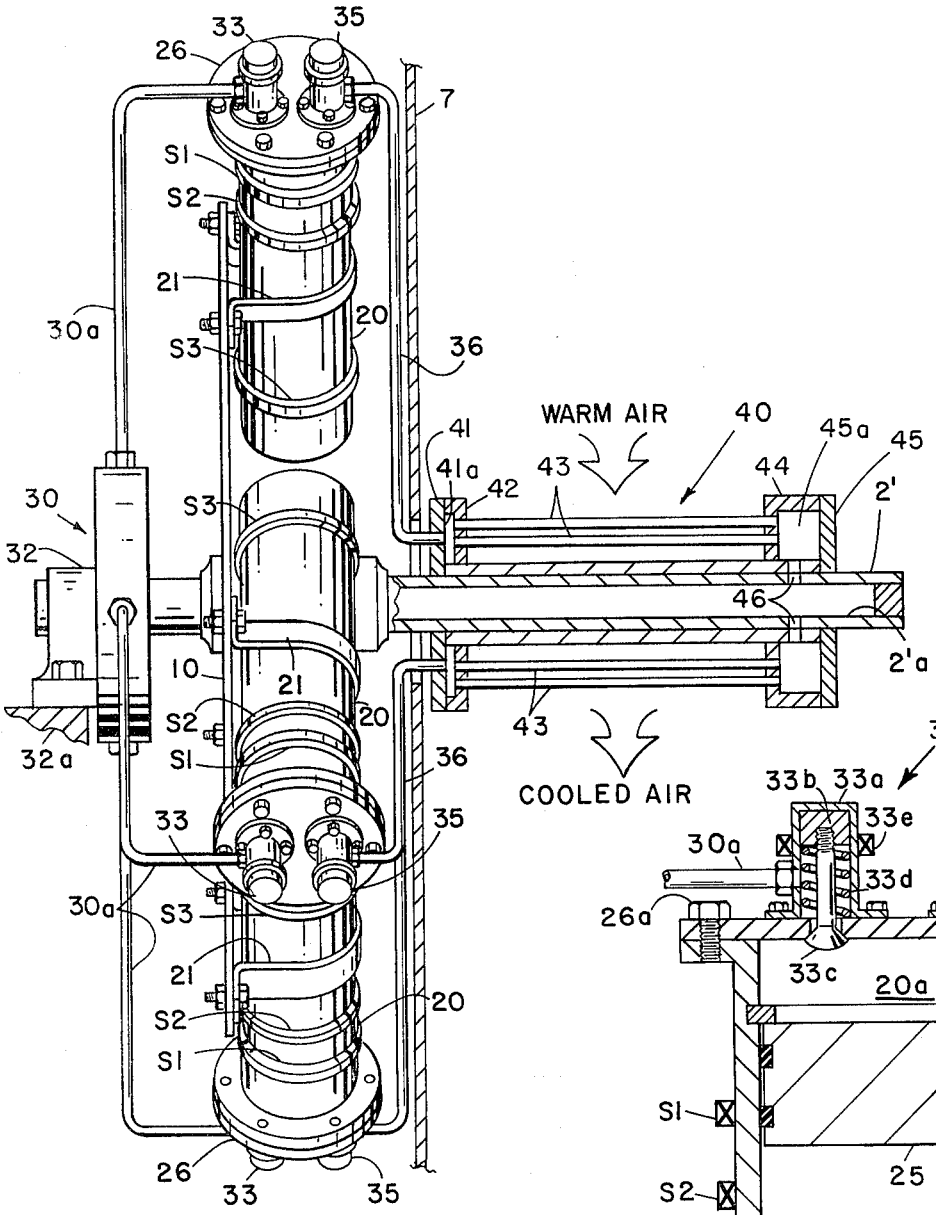
FIG. 10 is a schematic elevational view, partly in section, of a closed cycle air conditioning system incorporating the cylinders of FIG. 9.

Referring to FIG. 10, there is shown a closed cycle refrigerant system incorporating the exhaust valving arrangement of FIG. 9. It will be noted that the conduits 36 leading from the exhaust valve units 35 are respectively connected to the header 41 of the heat exchanger 40. All other elements of this structure are identical to those previously described in connection with the modification of FIG. 6.

Figure 11:
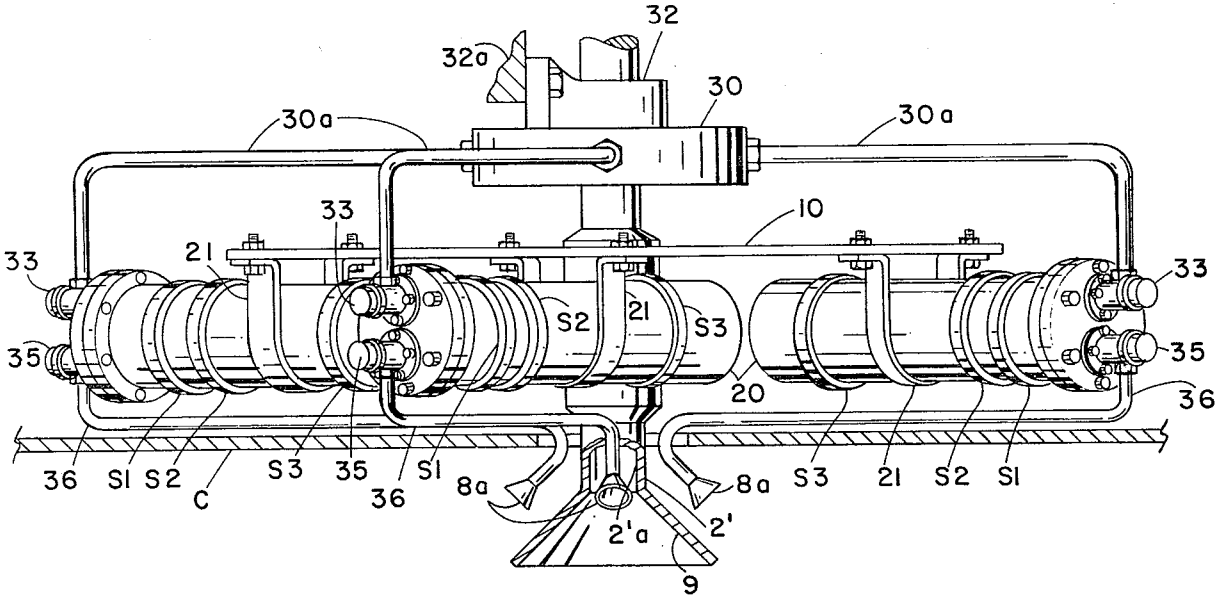
FIG. 11 is a schematic, elevational view, partly in section, of an open cycle air cooling system incorporating the cylinder elements of FIG. 9.

FIG. 11 shows the application of the exhaust valving mechanism of FIG. 9 to the open cycle type of air cooling device previously described in connection with FIG. 7. Exhaust conduits 36 connect exhaust valves 35 with discharge nozzles 8*a*. All other components are identical to the modification of FIG. 7.

Figure 12:
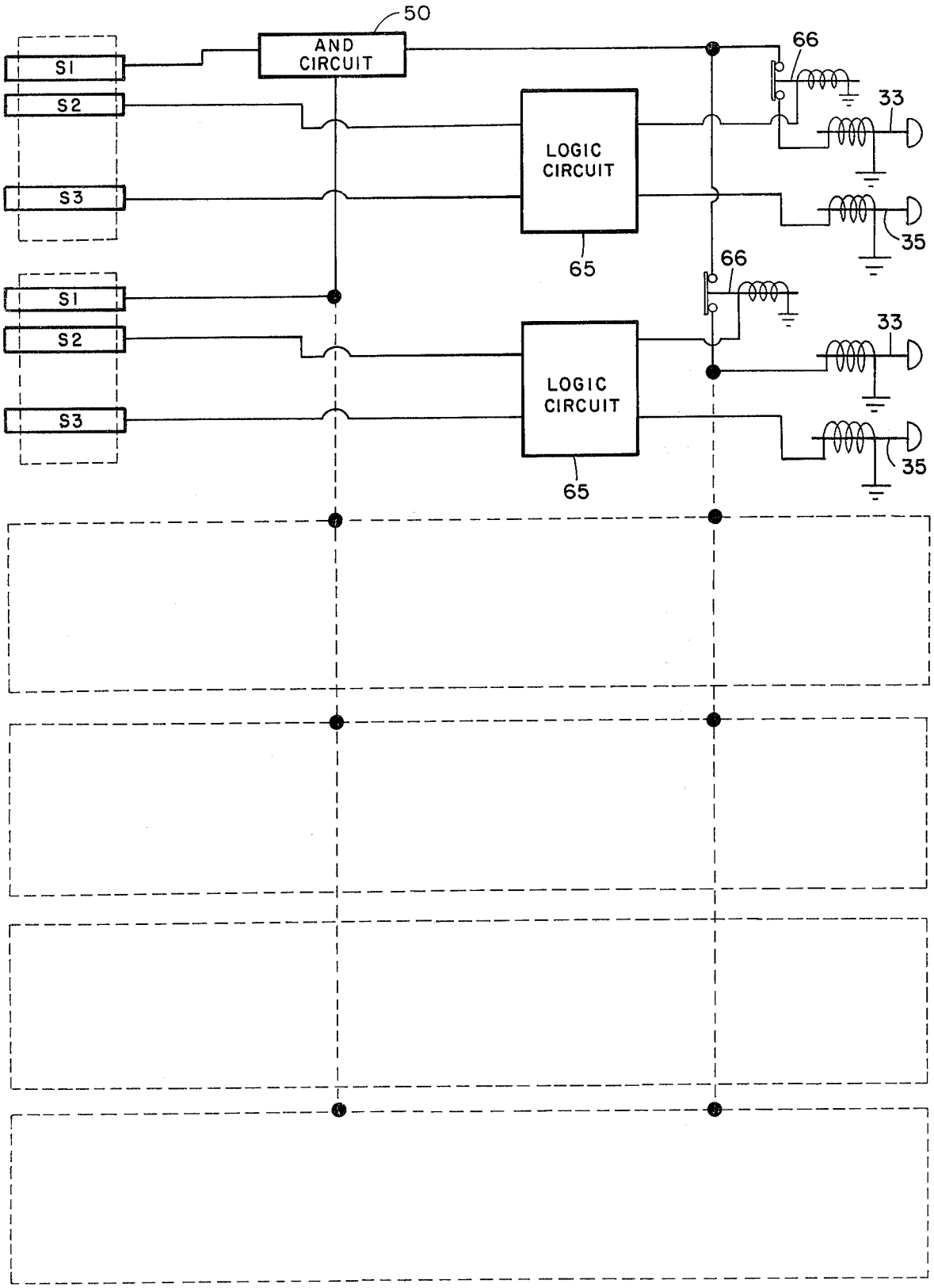
FIG. 12 is a schematic circuit diagram illustrating a control mode for the inlet and exhaust valves of the modifications of FIGS. 10 and 11.

The control circuitry, illustrated in FIG. 12, must, of course, be modified to provide for the operation of the solenoid controlled exhaust valve 35 at the proper intervals as determined by the position of the free piston 25 in the respective fluid pressure chamber 20*a*. Such operation may be accomplished through the addition of a third sensor S3 to each of the cylinders 20 at a position near the axis proximate end of the fluid pressure chamber 20*a*. Thus, sensor S3 detects when the respective free piston 25 reaches its extreme inward or axis proximate position. When each free piston 25 arrives at such position, the signal generated by sensor S3 operates through a conventional logic circuit 65 to effect the opening of the respective exhaust valve 35. A conventional locking circuit (not shown) holds exhaust valve 35 open. The sensors S1, which are located adjacent to the outermost or axially remote position of the free piston 25 function through an AND circuit 50, in the same manner as described in connection with FIG. 4, to cause the concurrent opening of all of the solenoid actuated inlet valves 33. The sensor S2 now performs a dual function. On the inward movement of the free piston 25, the respective sensor S2 produces a signal which operates through the logic circuit 65 to effect the closing of the respective inlet valve 33. On the return movement of the free piston 25, the sensor S2 produces a signal which operates through the logic circuit 65 to produce a signal to open relay 66 and effect the closing of the solenoid actuated exhaust valve 35.

It is therefore apparent that the expanded, cooled gas is discharged by the centrifugal force induced outward strokes of the free pistons 25 through the solenoid actuated exhaust valves 35 during a substantial portion of the outward strokes of such pistons. Thus, the cooled, expanded gas is forcibly applied to the inlet of the heat exchanger 40 in the modification of FIG. 11 or directly to the room to be cooled in the modification of FIG. 12.

As in the case of modifications previously described, a control circuit similar to FIG. 5 may be employed to control the opening of the solenoid actuated inlet valves 33 so that two diametrically opposed pairs of cylinders 20 are supplied with gas at the same instant, but in timed relationship to the supply of pressured gas to the remaining pairs of diametrically opposed cylinders. Also, any of the arcuate, spiral or helical-spiral configurations of fluid pressure chambers described in my aforementioned co-pending parent application may be utilized with the exhaust valve and control circuit represented by the modifications of FIGS. 9 through 11. Those skilled in the art will recognize that the many modifications of this invention heretofore described provide the utmost flexibility in designing a simplified apparatus for extraction of heat and/or mechanical energy from a pressured gas. Depending on the desired characteristics of the apparatus, the design may result in an apparatus producing substantial amounts of mechanical energy from a pressured gas. Alternately, the apparatus may be designed to primarily effect a cooling of the pressured gas for use in an air cooling system in either an open or closed cycle, but in either event deriving a mechanical energy input from expansion of the pressured gas to assist in the rotation of the power shaft. Thus, the motor 3 that is provided is primarily a starting motor, necessary for the purpose of getting the device up to sufficient speed to maintain the pistons in their radially outermost positions. After pressured gas is applied to the outermost ends of the fluid pressure chambers, the reaction force of the gas acting on the outermost ends of such chambers produces a torque tending to increase or maintain the velocity of the rotating power shaft. Hence, an energy efficient prime mover, air conditioning or air cooling system is provided.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed is:

1. Apparatus for extracting heat and mechanical energy from a pressured gas comprising: a body rotatable about an axis; power means for rotating said body; a plurality of cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each free piston extending from a position proximate to said axis to a position remote from said axis; whereby centrifugal force will move said free pistons to said remote position; inlet valve means communicating between a source of pressured gas and the remote end of each said cylinder element; means for opening said inlet valve means only when all of said free pistons reach said remote positions to concurrently receive a charge of pressured gas in the respective fluid pressure chamber; and exhaust valve means respectively communicating with said fluid pressure chambers and openable only when said free pistons respectively approach said proximate position, whereby said free pistons are removed in substantial synchronism in response to said each charges of pressured gas.

2. The apparatus of claim 1 wherein said cylinder elements are of longitudinally curved configuration.

3. The apparatus of claim 1 wherein said fluid pressure chambers are of longitudinally curved configuration and the axially remote end of each said fluid pressure chamber is defined by a wall disposed in a generally radial plane relative to said rotational axis.

4. The apparatus of claim 1 further comprising a room air heat exchanger having fluid passages therethrough; a compressor co-rotatable with said body; and conduit means for circulating cooled gas from said exhaust valve means through said fluid passages of said heat exchanger to the inlet of said compressor, and from the outlet of said compressor to the inlet valve means.

5. The apparatus of claim 1 wherein the pressured gas comprises air, and further comprising conduit means for connecting the exhaust valve means to a chamber to be cooled.

6. The apparatus of claim 1 wherein the pressured gas comprises air, and further comprising conduit means for connecting the exhaust valve means to a chamber to be cooled; a rotary compressor co-rotatable with said rotatable body; and second conduit means for connecting said chamber to the inlet of said rotary compressor and the outlet of said rotary compressor to said fluid inlet valve means.

7. Apparatus for extracting heat and mechanical energy from a pressured gas comprising: a body rotatable about an axis; power means for rotating said body; a plurality of diametrically opposed cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each piston extending from a position proximate to said axis to a position remote from said axis whereby centrifugal force will move said free piston to said remote position; inlet valve means communicating between a source of pressured gas and the remote end of each said cylinder element; means for opening said inlet valve means of each diametrically opposed pair of cylinder elements only when the respective free pistons reach said remote positions to concurrently receive a charge of pressured gas in the respective fluid pressure chambers; and exhaust valve means respectively communicating with said fluid pressure chambers and openable only when said free pistons respectively approach said proximate position, whereby said free pistons in each said pair of diametrically opposed pistons move in substantial synchronism in response to said charges of pressured gas.

8. The apparatus of claim 7 wherein said cylinder elements are of longitudinally curved configuration.

9. The apparatus of claim 7 wherein said fluid pressure chambers are of longitudinally curved configuration and the axially remote end of each said fluid pressure chamber is defined by a wall disposed in a generally radial plane relative to said rotational axis.

10. The apparatus of claim 7 further comprising a room air heat exchanger having fluid passages therethrough; a compressor co-rotatable with said body; and conduit means for circulating cooled gas from said exhaust valve means through said fluid passages of said heat exchanger to the inlet of said compressor, and from the outlet of said compressor to the inlet valve means.

11. The apparatus of claim 7 wherein the pressured gas comprises air, and further comprising conduit means for connecting the exhaust valve means to a chamber to be cooled.

12. The apparatus of claim 7 wherein the pressured gas comprises air, and further comprising conduit means for connecting the exhaust valve means to a chamber to be cooled; a rotary compressor co-rotatable with said rotatable body; and second conduit means for connecting said chamber to the inlet of said rotary compressor and the outlet of said rotary compressor to said fluid inlet valve means.

13. Apparatus for extracting heat and mechanical energy from a pressured gas comprising: a body rotatable about an axis; power means for rotating said body; a plurality of cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each free piston extending from a position proximate to said axis to a position remote from said axis; whereby centrifugal force will move said free pistons to said remote position; inlet valve means communicating between a source of pressured gas and the remote end of each said cylinder element; sensing means on each said cylinder elements for detecting the presence of the respective said piston at said remote and said proximate positions; means responsive to said sensing means for opening said inlet valve means only when all of said free pistons reach said remote positions to concurrently receive a charge of pressured gas in the respective fluid pressure chamber; and exhaust valve means respectively communicating with said fluid pressure chambers; and means responsive to said sensing means for opening said exhaust valve means only when said free pistons respectively approach said proximate position, whereby said free pistons are moved in substantial synchronism in response to said charges of pressured gas.

14. The apparatus of claim 13 wherein said cylinder elements are of longitudinally curved configuration.

15. The apparatus of claim 13 wherein said fluid pressure chambers are of longitudinally curved configuration and the axially remote end of each said fluid pressure chamber is defined by a wall disposed in a generally radial plane relative to said rotational axis.

16. The apparatus of claim 13 further comprising a room air heat exchanger having fluid passages therethrough; a compressor co-rotatable with said body; and conduit means for circulating cooled gas from said exhaust valve means through said fluid passages of said heat exchanger to the inlet of said compressor, and from the outlet of said compressor to the inlet valve means.

17. The apparatus of claim 13 wherein the pressured gas comprises air, and further comprising conduit means for connecting the exhaust valve means to a chamber to be cooled.

18. The apparatus of claim 13 wherein the pressured gas comprises air, and further comprising conduit means for connecting the exhaust valve means to a chamber to be cooled; a rotary compressor co-rotatable with said rotatable body; and second conduit means for connecting said chamber to the inlet of said rotary compressor and the outlet of said rotary compressor to said fluid inlet valve means.

19. Apparatus for extracting heat and mechanical energy from a pressured gas comprising: a body rotatable about an axis; power means for rotating said body; a plurality of cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each free piston extending from a position proximate to said axis to a position remote from said axis; whereby centrifugal force will move said free pistons to said remote position; inlet valve means communicating between a source of pressured gas and the remote end of each said cylinder element; exhaust valve means respectively communicating with said fluid pressure chambers; a first sensing means on each cylinder element for detecting the presence of the respective free piston at said remote position; a second sensing means on each cylinder element for sensing the presence of the respective free piston at a medial position between said remote and said proximate positions; a third sensing means on each said cylinder element for sensing the presence of the respective free piston at said proximate position; means responsive to the operation of all said first sensing means for concurrently closing all said exhaust valve means and opening all said inlet valve means to introduce charges of pressured gas into all said fluid pressure chambers; means responsive to said second sensing means for respectively closing said inlet valve means, and means responsive to said third sensing means for respectively opening said exhaust valve means, whereby said free pistons are moved in substantial synchronism by said charges of pressured gas.

20. The apparatus of claim 19 wherein said cylinder elements are of longitudinally curved configuration.

21. The apparatus of claim 19 wherein said fluid pressure chambers are of longitudinally curved configuration and the axially remote end of each said fluid pressure chamber is defined by a wall disposed in a generally radial plane relative to said rotational axis.

22. The apparatus of claim 19 further comprising a room air heat exchanger having fluid passages therethrough; a compressor co-rotatable with said body; and conduit means for circulating cooled gas from said exhaust valve means through said fluid passages of said heat exchanger to the inlet of said compressor, and from the outlet of said compressor to the inlet valve means.

23. The apparatus of claim 19 wherein the pressured gas comprises air, and further comprising conduit means for connecting the exhaust valve means to a chamber to be cooled.

24. The apparatus of claim 19 wherein the pressured gas comprises air, and further comprising conduit means for connecting the exhaust valve means to a chamber to be cooled; a rotary compressor co-rotatable with said rotatable body; and second conduit means for connecting said chamber to the inlet of said rotary compressor and the outlet of said rotary compressor to said fluid inlet valve means.

25. Apparatus for extracting heat and mechanical energy from a pressured gas comprising: a body rotatable about an axis; power means for rotating said body; a plurality of diametrically opposed cylinder elements secured to said rotating body in an equi-spaced array around said axis; each said cylinder element defining an elongated fluid pressure chamber; a free piston movable longitudinally in each said fluid pressure chamber; said cylinder elements being fixed on said rotatable body with the path of movement of each piston extending from a position proximate to said axis to a position remote from said axis; whereby centrifugal force will move said free piston to said remote position; inlet valve means communicating between a source of pressured gas and the remote end of each said cylinder element; exhaust valve means respectively communicating with said fluid pressure chambers and openable only when said free pistons respectively approach said proximate position; a first sensing means on each cylinder element for detecting the presence of the respective free piston at said remote position; a second sensing means on each cylinder element for sensing the presence of the respective free piston at a medial position between said remote and said proximate position; a third sensing means on each said cylinder element for sensing the presence of the respective free piston at said proximate position; means responsive to the operation of all said first sensing means for concurrently closing all the exhaust valves and opening said inlet valve means of each pair of diametrically opposed cylinder elements to introduce charges of pressured gas into the said fluid pressure chambers of said pair of cylinder elements; means responsive to said second sensing means for respectively closing said inlet valve means, and means responsive to said third sensing means for respectively opening said exhaust valve means, whereby said free pistons in each opposed pair of cylinder elements are moved in substantial synchronism by said charges or pressured gas.

26. The apparatus of claim 25 wherein said cylinder elements are of longitudinally curved configuration.

27. The apparatus of claim 25 wherein said fluid pressure chambers are of longitudinally curved configuration and the axially remote end of each said fluid pressure chamber is defined by a wall disposed in a generally radial plane relative to said rotational axis.

28. The apparatus of claim 25 further comprising a room air heat exchanger having fluid passages therethrough; a compressor co-rotatable with said body; and conduit means for circulating cooled gas from said exhaust valve means through said fluid passages of said heat exchanger to the inlet of said compressor, and from the outlet of said compressor to the inlet valve means.

29. The apparatus of claim 25 wherein the pressured gas comprises air, and further comprising conduit means for connecting the exhaust valve means to a chamber to be cooled.

30. The apparatus of claim 25 wherein the pressured gas comprises air, and further comprising conduit means for connecting the exhaust valve means to a chamber to be cooled; a rotary compressor co-rotatable with said rotatable body; and second conduit means for connecting said chamber to the inlet of said rotary compressor and the outlet of said rotary compressor to said fluid inlet valve means.

31. The method of operating an apparatus for extracting heat and mechanical energy from a pressured gas by a plurality of diametrically opposed cylinder elements rotating about an axis and respectively defining fluid pressure chambers extending from a point remote from said axis to a position proximate said axis; said cylinders respectively containing free pistons, an inlet valve communicating with a source of pressured fluid, and an exhaust valve for cooled fluid, comprising the steps of:

1. Sensing the position of each free piston as it approaches the remote and the proximate ends of the fluid pressure chamber;
2. Concurrently closing the exhaust valves and opening the inlet valves of two diametrically opposed cylinder elements when the respective free piston elements both reach said remote end of the respective fluid pressure chamber; and
3. Opening the exhaust valve of each cylinder when the respective free piston reaches said proximate end of the fluid pressure chambers, whereby said free pistons of the diametrically opposed cylinders move in substantial synchronism.

32. The method of operating an apparatus for extracting heat and mechanical energy from a pressured gas by a plurality of diametrically opposed cylinder elements rotating about an axis and respectively defining fluid pressure chambers extending from a point remote from said axis to a position proximate said axis; said cylinders respectively containing free pistons, an inlet valve communicating with a source of pressured fluid, and an exhaust valve for cooled fluid, comprising the steps of:

1. Sensing the position of each free piston as it moves between the remote and the proximate ends of the respective fluid pressure chamber;
2. Concurrently closing the exhaust valves and opening the inlet valves of two diametrically opposed cylinder elements when the respective free piston elements both reach said remote end of the respective fluid pressure chamber;
3. Closing said inlet valves when the respective pistons reach a medial position between said proximate and remote ends of the fluid pressure chamber; and
4. Opening the exhaust valve of each cylinder when the respective free piston reaches said proximate end of the fluid pressure chambers, whereby said free pistons of the diametrically opposed cylinders move in substantial synchronism.

33. The method of operating an apparatus for extracting heat and mechanical energy from a pressured gas by a plurality of cylinder elements rotating about an axis and respectively defining fluid pressure chambers extending from a point remote from said axis to a position proximate said axis; said cylinders respectively containing a free piston, an inlet valve communicating with a source of pressured fluid, and an exhaust valve for cooled fluid, comprising the steps of:

1. Sensing the position of each free piston as it approaches the remote and the proximate ends of the fluid pressure chamber;
2. Concurrently closing the exhaust valves and opening the inlet valves of all said cylinders when all said free pistons respectively reach said remote ends of said fluid pressure chambers; and
3. Opening the exhaust valve of each cylinder when the respective free piston reaches said proximate end of the fluid pressure chamber, whereby said free pistons move in substantial synchronism.

34. The method of operating an apparatus for extracting heat and mechanical energy from a pressured gas by a plurality of cylinder elements rotating about an axis and respectively defining fluid pressure chambers extending from a point remote from said axis to a position proximate said axis; said cylinders respectively containing a free piston, an inlet valve communicating with a source of pressured fluid, and an exhaust valve for cooled fluid, comprising the steps of:

1. Sensing the position of each free piston as it approaches the remote and the proximate ends of the fluid pressure chambers;
2. Concurrently closing the exhaust valves and opening the inlet valves of all said cylinders when all said free pistons respectively reach said remote ends of said fluid pressure chambers;
3. Closing said inlet valves when the respective pistons reach a medial position between said proximate and remote ends of the fluid pressure chambers; and
4. Opening the exhaust valve of each cylinder when the respective free piston reaches said proximate end of the fluid pressure chamber, whereby said free piston move in substantial synchronism.

* * * * *

UNITED STATES PATENT AND TRADEMARK OFFICE

CERTIFICATE OF CORRECTION

PATENT NO. : 4,420,945

DATED : December 20, 1983

INVENTOR(S) : Edwin W. Dibrell

It is certified that error appears in the above–identified patent and that said Letters Patent are hereby corrected as shown below:

Column 3, line 22, "bove" should be --above--.

Column 4, line 57, "suitble" should be --suitable--.

Column 6, line 34, "26" should be --25--.

Column 6, line 56, "rotation" should be --rotational--.

Column 7, line 12, "acheve" should be --achieve--.

Column 7, line 20, "sensor" should be --sensors--.

Column 8, line 61, "working" should be --moving--.

Column 9, line 19, "of" should be --Of--.

Column 9, line 26, "applied" should be --supplied--.

Column 9, line 37, "26" should be --25--.

Column 10, line 3, "the" should be --The--.

Column 13, line 47, "removed" should be --moved--.

Column 17, line 7, "or" should be --of--.

Column 18, line 63, "piston" should be --pistons--.

Signed and Sealed this

*Fifth* Day of *June 1984*

[SEAL]

*Attest:*

GERALD J. MOSSINGHOFF

*Attesting Officer*

*Commissioner of Patents and Trademarks*